US006416041B1

(12) United States Patent
Sicking et al.

(10) Patent No.: US 6,416,041 B1
(45) **Date of Patent: *Jul. 9, 2002**

(54) GUARDRAIL SYSTEM

(75) Inventors: Dean Leo Sicking; John Douglass Reid; Ronald Keith Faller; Brian George Pfeifer; Barry Thomas Rosson; John Robert Rohde, all of Lincoln, NE (US)

(73) Assignee: The Board of Regents of the University of Nebraska, Lincoln, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/772,559

(22) Filed: Dec. 26, 1996

Related U.S. Application Data

(63) Continuation-in-part of application No. 08/583,307, filed on Jan. 5, 1996, now Pat. No. 6,260,827.

(51) Int. Cl.[7] ..... A01K 3/00
(52) U.S. Cl. ..... 256/13.1; 256/59
(58) Field of Search ..... 256/13.1, 1, 24, 256/59, 65; 404/6, 7, 9

(56) References Cited

U.S. PATENT DOCUMENTS 2,536,760 A 1/1951 Martin et al.
3,214,142 A 10/1965 Brown et al.

OTHER PUBLICATIONS

"Highway Guardrails—A Review of Current Practice" National Cooperative Highway Research Program Report 36; Norman J. Deleys and Raymond R. McHenry; Highway Research Board, Div. of Engineering, National Research Council, National Academy of Sciences—National Academy of Engineering, 1967.

"Guardrail Performance and Design" National Cooperative Highway Research Program Report 115; Jarvis D. Michie, et al.; Highway Research Board, Div. of Engineering, National Research Council, National Academy of Sciences—National Academy of Engineering, 1971.

*Primary Examiner*—Brian K. Green
*Assistant Examiner*—William L. Miller
(74) *Attorney, Agent, or Firm*—Vincent L. Carney

(57) ABSTRACT

To reduce the tendency for high center of mass vehicles to roll, or vault over a guardrail barrier or dive under it, the guardrail barrier has outer curved portions selected to adjust the moment of inertia of the guardrail barrier by providing a sufficiently high moment of inertia to slow the vehicle but sufficiently low to avoid excessive force against the occupant compartment. A central portion connecting the outer curves sized to provide an effective depth of 12.25 inches to capture high bumper vehicles and small vehicles and an area of 1.99 inches to provide rigidity enough to the curved portions to avoid flattening and penetration. The outer curves are asymmetrical.

16 Claims, 2 Drawing Sheets

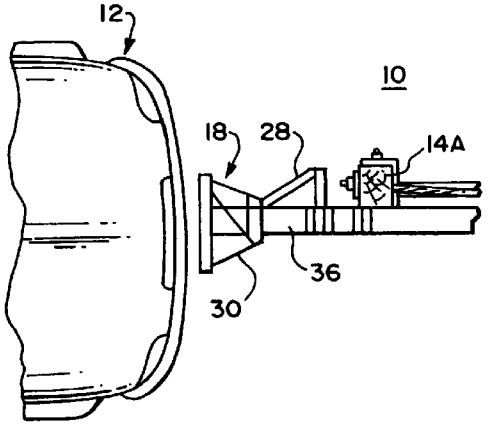
FIG. 4
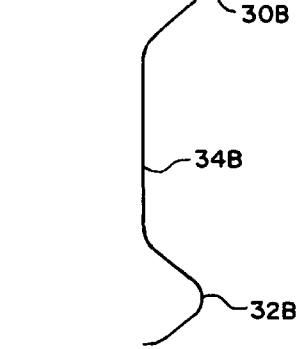
FIG. 5
FIG. 6
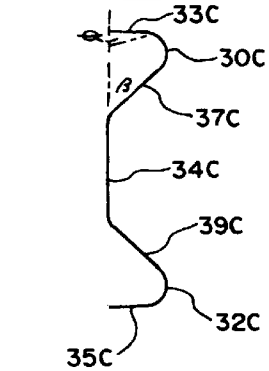
FIG. 7
FIG. 8
FIG. 9
FIG. 10
FIG. 11
FIG. 12
FIG. 13

GUARDRAIL SYSTEM

RELATED CASES

This patent application is a continuation-in-part of U.S. patent application Ser. No. 08/583,307 filed Jan. 5, 1996, now U.S. Pat. No. 6,260,827, in the name of Sicking, et al., for GUARDRAIL SYSTEM.

BACKGROUND OF THE INVENTION

This invention relates to roadway guardrail systems, and more particularly, to guardrail barriers.

Guardrail barriers are positioned along roadways to prevent or reduce the damage to vehicles and to their occupants when they leave the roadway. The guardrail barriers are designed to redirect the vehicle back onto the roadway and to absorb energy in a controlled manner from the vehicle. The barrier is supported on posts or the like and may have different amounts of flexibility depending on its design. It provides an effective depth or capture area intended to receive the moving vehicle in a recessed portion of the guardrail barrier bounded by upper and lower curved portions projecting toward the roadway to stabilize the vehicle and reduce the tendency for the vehicle to vault over or dive under the barrier or to roll when redirected by holding the vehicle against upward and downward motion. The barriers should be positioned with the lower peak of the curved portions no higher than 20.5 inches from the ground. Terminals are located at the ends of the guardrail system's barrier to receive vehicles that hit at the end. The terminals and the barriers work together to absorb energy when the terminal is hit.

While prior art barriers differ one from the other and have many types of designs, the most common type of prior art barrier in the United States is a W-Beam, galvanized versions of which are dimmensioned to have an area of its cross sectional edge of 1.99 square inches (in.$^2$), a thickness of its edge of 0.1046 inches (in.), a gauge of 12, a depth from the top edge vertically down to the bottom edge of 12.25 inches, an effective depth from the centerline of the uppermost curved portion of the barrier (horizontal radius) to the centerline of the lowermost curved portion (horizontal radius) of 7.63 inches, a width (from vertical plane touching the barrier at the point farthest from the road center to vertical plane touching barrier nearest road center—i.e. peak of positive curve to peak of negative curve) of 3.35 inches.

This standard W-beam has an Xbar (distance from lower edge vertically to centroid) of 6.13 inches, a Ybar (distance from peak of positive curve to centroid) of 1.69 inches, an Ix (vertical moment of inertia) of 29.65 in.$^4$, a horizontal moment of inertia, Iy, of 2.32 in.$^4$, an Sx (vertical section modulus) of 4.84 in.$^3$, an Sy1 (horizontal section modulus at positive peak) of 1.38 in.$^3$, an Sy2 (horizontal section modulus at negative peak) of 1.40 in.$^3$, a length (length of edge of a section if it were straight) of 19 inches, and a weight per length of the barrier of 6.77 pounds per foot. The outer curved portions of standard w-beams are each symmetrical about a horizontal line through its peak. Usually, sections of w-beams are spliced together by eight bolts, one row of four bolts on each side of the post bolts, evenly spaced so that two of the four are on the outer section of the peak of each outer curve and two on the inner section.

Barriers with these dimmensions operate well on some vehicles but have several disadvantages as to other vehicles, such as for example: (1) they provide so much resistances to high center of mass vehicles that, under an undesirably large number of circumstances, they cause the center of mass to rise to a height over the vertical, resulting in the vehicle rolling or vaulting over the guardrail; and (2) certain vehicles with a high center of mass and high bumper mounting heights are not captured by the prior art W-beam guardrails. Thus, certain light trucks, such as pick-ups, vans and sport-utility vehicles may be caused to roll and sometimes vault over the guardrail barrier. However, the W-beam barrier cannot be raised because small cars would wedge under the railing and snag on the guardrail posts.

SUMMARY OF THE INVENTION

Accordingly, it is an object of the invention to provide a novel guardrail system.

It is a further object of the invention to provide a novel guardrail barrier or rail.

It is a still further object of the invention to provide a guardrail system in which the guardrail barrier captures higher center gravity vehicles such as pick-up trucks, vans, utility vehicles and the like.

It is a still further object of the invention to provide a novel guardrail system in which the guardrail barrier absorbs energy in a controlled manner such as for example by buckling, bending cutting or other metal working when the terminal is impacted. It is a further object of the invention to provide a novel guardrail system in which the membrane characteristics of a guardrail are balanced against the beam characteristics to reduce the tendancy of vehicles with a high center of mass from rolling, vaulting over the guardrail barrier or diving under the guardrail barrier upon hitting the guardrail barrier.

It is a still further object of the invention to provide a larger capture area in a guardrail barrier to receive a wider variety of bumper heights, shapes and sizes on vehicles.

It is a still further object of the invention to provide a novel guardrail able to usefully affect deceleration rates of impacting objects at low force levels and still function with high force levels.

It is a still further object of the invention to provide a novel guardrail formed of sufficiently thin material.

It is a still further object of the invention to increase the likelihood of fast local buckling.

In accordance with the above and further objects of the invention, the shape of the guardrail barrier is tailored to reduce the tendancy of the vehicle to roll, vault over the guardrail or dive under the guardrail and to accomodate impact with an end terminal. It has been discovered that, with some designs, the tendancy of vehicles with a high center of mass to roll or vault over the guardrail barrier upon hitting the guardrail barrier can be reduced by decreasing the thickness of the guardrail barrier sheet material and increasing the depth and effective depth of the barrier without significantly increasing the weight per unit length, the tendency to penetrate the occupant compartment and section modulus. The design also accomodates vehicles that impact the terminal end of the guardrail system or tend to dive under the guardrail barrier.

The beneficial results are obtained from a barrier having dimensions falling within certain ranges such as for example a range of edge areas, reflecting the amount of steel or other material per unit length of guardrail barrier, and the effective depths. These ranges mean that each of the values must fall within the range for that value. This range is between an edge area of substantially 1.6 square inches with an effective depth of substantially 15 inches to an edge area of substantially 2.4 square inches with an effective depth of substantially 9 inches. The preferred edge area and effective depth are substantially 1.99 square inches edge area with substantially 12.25 inches effective depth and the effective section modulus is 1.31. The section modulus, $^{s}y$, should fall within the range of 0.94 to 1.7.

A range of effective depths and moments of inertia is from an effective depth of 15 inches with a moment of inertia of 3.57 in.$^4$ to an effective depth of 9 inches with a moment of inertia of 1.38in.$^4$. The preferred moment of inertia is 2.39 in.$^4$.

A range of peak crush strength is between 3 kips (one kips is equal to thousand pounds) per foot to 6.5 kips per foot. The preferred peaks crush strength is 4.97 kips per foot. A suitable range of energy absorption caused by crushing is between 7 kips in. per foot and 15 kips in. per foot. The preferred value is 10.7 kips in. per foot or rail. This is best obtained by asymmetrical end curves with ratios of angles of the sloping inner side of outer curves to angles of outer side of curves (facing angles) with the vertical of 1.2 to 6. The preferred angles are 43.5 degrees for inner side and 78.66 degrees for outer curve with a ratio of 1.8.

To prevent tearing out bolts at between sections, 10 or more bolts in several rows should be used to hold the sections together. Each bolt should have a bearing area less than 0.079 square inches. The total bearing area should be at least 0.56 square inches.

The beam energy absorbing characteristics and membrane characteristics are selected principally by controlling the moment of inertia and the edge area. The vehicle redirecting characteristics and to some extent the energy storing and yield characteristics are determined by the location of the centroid and radii of gyration. The capture area is determined by the geometry while maintaining the desired moment of inertia, and edge area. For economic reasons and for proper guardrail terminal impact management, the thickness and linear length of the material used to form the barrier must be considered in the design.

Special materials, such as aluminum or composites, may be used in locations where justified by economic and safety factors. For example, a relatively ductile material with a shape having a wide capture area may receive bumpers at different elevations and shapes, and still hold the vehicle while the material absorbs energy over a longer distance than conventional. The absorption of energy from the vehicle over the longer distance may avoid the center of mass of the vehicle raising over the vertical and rolling the vehicle or causing it to vault over the guardrail. For this purpose, a relatively thin steel guardrail barrier or aluminum barrier that is thicker or some other compromise between the membrane effect and intertia-energy-absorption effect may be used. For substituting materials with a different modulus of elasticity than steel, the area multiplied by the new modulus should remain the same and the moment of inertia multiplied by the new modulus should remain the same.

It has been discovered that the tendency of vehicles to roll or vault over the barrier is greatly reduced if it has characteristics falling within a certain range from a first set of characteristics to a second set of characteristics. Surprisingly, the range of characteristics includes a reduced thickness (increased gauge) of material and an increased depth and effective depth without a corresponding increase in section modulus or in the weight per unit length of the barrier of such an extent as to greatly increase the cost or permit easy flattening, tearing or penetration by the vehicle. The characteristics defining the range between the first set of characteristics and second set are not necessarily found in only one barrier design.

The first set of characteristics is: (1) an edge area of substantially 1.6 square inches; (2) a thickness of substantially 0.0721 inches; (3) a depth of substantially 14.5 inches; (4) an effective depth of substantially 9 inches; (5) a moment of inertia, Iy, of substantially 1.38 in.$^4$; and (6) an Sy of substantially 0.92 in.$^3$.

The second set of characteristics is: (1) an area of substantially 2.4 square inches; (2) a thickness of substantially 0.1082 inches; (3) a depth of substantially 19.0 inches; (4) an effective depth of substantially 15 inches; (5) a moment of inertia, Iy, of substantially 3.57 in.$^4$; and (6) an Sy of substantially 1.7 in.$^3$.

A range of possible first values for a first barrier at one end of the range and possible second values for a second barrier at the other end of the range is: (1) for the first barrier—an area of substantially 1.6 square inches, a thickness of substantially 0.0721 inches, an effective depth of substantially 15 inches, a moment of inertia, Iy, of substantially 1.38 in.$^4$, an Sy of substantially 0.92 in.$^3$; to (2) for the second barrier—an area of substantially 2.4 square inches, a thickness of substantially 0.1082 inches, an effective depth of substantially 9 inches, a moment of inertia, Iy, of substantially 3.57 in.$^4$, an Sy of substantially 1.7 in.$^3$.

From the above description it can be understood that the guardrail barrier of this invention has several advantages such as: (1) it permits absorbing of energy, such as for example by efficient buckling, bending, cutting or other metal working when the vehicle hits a terminal; (2) it provides a long capture area for vehicles that are at different elevations from the ground; (3) it reduces the tendency for vehicles having a high center of mass to roll, vault over the barrier while at the same time preventing small vehicles from diving under the barrier; (5) it permits adaptation of the guardrail to vehicles having different heights of centers of masses and bumper heights; and (6) it permits economizing with the amount of metal to achieve the desired result of redirection of vehicles and slowing them down while protecting them from leaving the road and without causing premature failure of the guardrail material.

SUMMARY OF THE DRAWINGS

The above-noted and other features of the invention will be better understood from the following detailed description when considered with reference to the accompanying drawings in which:

FIG. 4 is a fragmentary plan view of a vehicle hitting the terminal of the guardrail system of FIG. 1;

FIG. 5 is a side view of a guardrail configuration in accordance with an embodiment of the invention;

FIG. 6 is a side view illustrating the shape of a guardrail of still another embodiment of the invention;

FIG. 7 is a side view of a preferred embodiment of guardrails;

FIG. 8 is a side view of still another embodiment of guardrails;

FIG. 9 is a side view of still another embodiment of guardrails;

FIG. 10 is a side view of still another of embodiment of guardrails;

FIG. 11 is a side view of still another embodiment of guardrails;

FIG. 12 is a side view of still another embodiment of guardrails; and

FIG. 13 is a side view of still another embodiment of guardrails.

DETAILED DESCRIPTION

Figure 1:
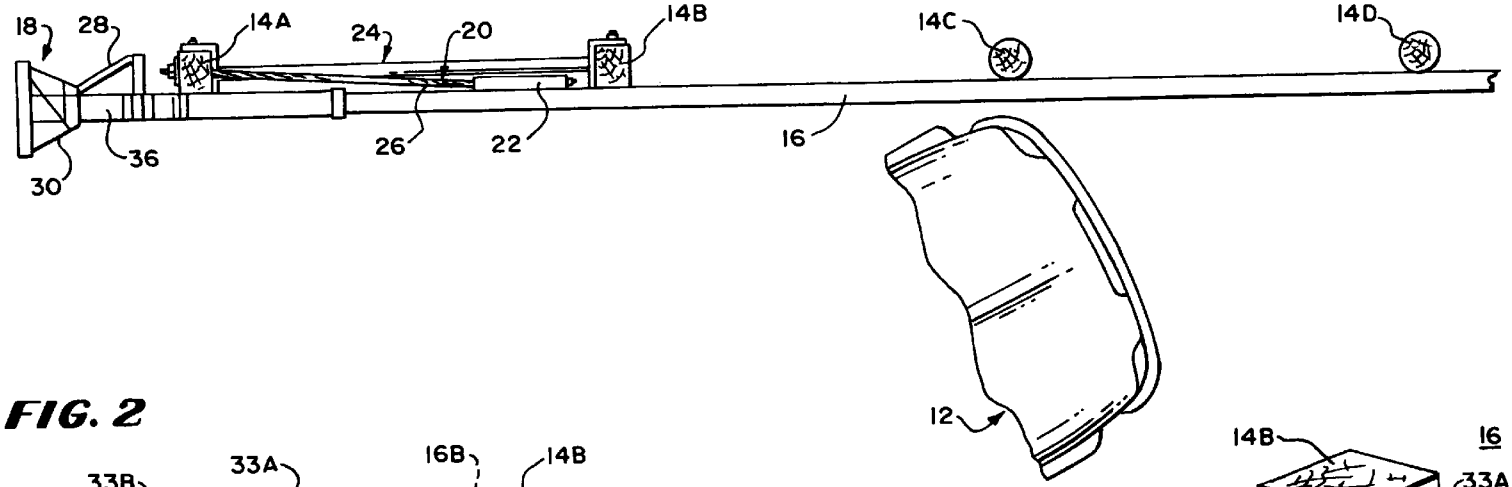
FIG. 1 is a plan view illustrating the action of a vehicle impacting the guardrail barrier.

In FIG. 1 there is shown a plan view of a guardrail system 10 about to be impacted by a vehicle 12. The guardrail system 10 includes a plurality of posts, four of which are shown at 14A, 14B, 14C and 14D, a guardrail barrier 16, a terminal assembly 18 and a cable anchoring system 20, with the terminal assembly 18 being at one end of the guardrail barrier 16 and cable anchoring system 20 connecting the guardrail barrier 16 to a support. The guardrail barrier 16 is mounted to the posts 14A–14D to be substantially parallel to a roadway.

In this guardrail system, the terminal assembly 18 and a guardrail barrier 16 cooperate together to reduce the likelihood of bodily injury to passengers and guests in the vehicle 12 when the vehicle 12 leaves the roadway and impacts against the guardrail barrier 16 or impacts against the terminal assembly 18 at the end of the guardrail barrier. The terminal assembly 18 may be of any suitable type, but is preferably a terminal that cooperates with the guardrail barrier 16 to cause the absorption of energy such as for example by the buckling, bending, cutting or other metal working of the guardrail barrier 16.

In the preferred embodiment, the guardrail barrier 16 is formed of metal and relies upon a combination of elongation to permit movement of the vehicle and absorption of energy by metal working to reduce the likelihood of bodily injury to passengers in the vehicle. The stretching or elongation action of the guardrail is balanced with the energy absorption from metal working such as bending to provide a slow enough attenuation of the vehicle's energy to avoid the likelihood of a high center of mass lifting upwardly to cause the vehicle to roll and particularly to avoid its vaulting over the guardrail.

The posts 14A–14D may be of any general type, but in the preferred embodiment are either wood or steel posts and include blockouts. The guardrail barrier 16 mounted the side of the posts facing the roadway by fasteners such as bolts or the like. The terminal assembly 18 is mounted to the guardrail barrier 16 at one end and positioned so that it may move in the direction of the guardrail as the guardrail buckles, bends or is altered in another energy saving manner when the terminal is impacted by the vehicle 12 as best shown in FIG. 4.

Figure 2:
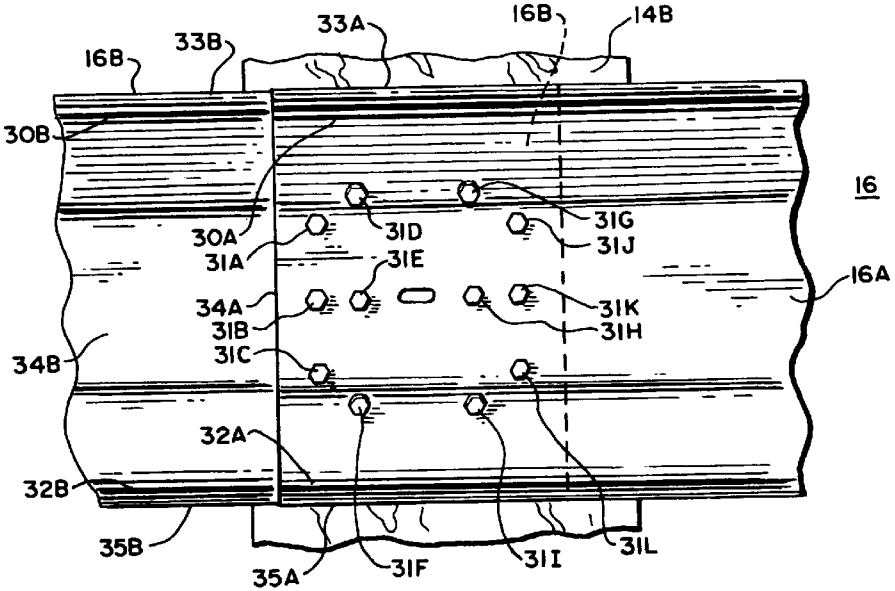
FIG. 2 is a fragmentary front elevational view of a portion of the guardrail barrier of FIG. 1.

In FIG. 2 there is shown a fragmentary elevational view of a W-beam guardrail barrier 16 a first section 16A and a section section 16B, each having a corresponding one of the outer asymmetric top and bottom curves or humps 30A, 30B and 32A, 32B (hereinafter referred to as outer curves) of high moment of inertia, extending toward the center of the roadway (hereinafter referred to as positive direction for curves), each of which are similar and have a relatively short radius of curvature with a center point extending away from the center of the roadway (hereinafter referred to as positive direction for centers of curvature) and a corresponding one of the central curved or straight portions 34A, 34B (hereinafter referred to as center portions) with curves facing away from the center of the roadway in the negative direction, having a larger radius of curvature than the outer curves and having a center of curvature facing the roadway (negative direction).

The sections 16A and 16B are spliced and held by 12 bolts 31A–31L, arranged in four rows of three bolts located between the peaks 30A, 30B and 32A, 32B. At least 10 bolts should be used. This provides at least 0.56 square inches of contact between each section and a guardrail and reduces the possibility of tearing of the guardrail at the bolts. It has been found that the bolts are less likely to tear the guardrail barrier if the outer row of bolts 31A, 31B and 31C are all between the peaks rather than the beginning row and end rows of bolts being outside the peaks. Each of the bolts provides surface contact with each of the sections in a direction parallel to the longitudinal axis of the sections of less than 0.079 square inches.

While in the embodiment of FIG. 2, the radius of curvature of the upper and lower outer curves 30 and 32 are the same and their centers face away from the roadway in the preferred embodiment, they can have different radii of curvature and their centers can face the roadway. The center portions 34A, 34B are flat or have a much longer radius of curvature than the outer curves 30A, 30B and 32A, 32B. If curved, they have inevitably centers of curvature in the opposite direction as the upper and lower outer curves 30A and 32A. The center sections may also have still another smaller curved portion somewhere along its length such as at its center, with a center of curvature facing in the same direction of the upper and lower outer curves 30A, 30B and 32A, 32B but being shorter in radius.

Figure 3:
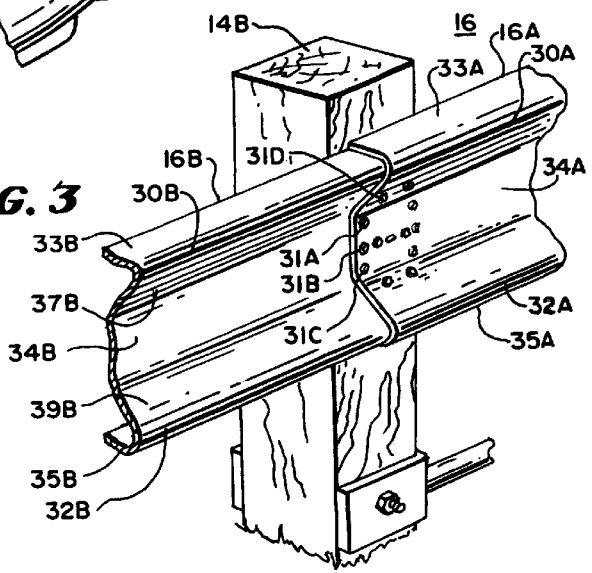
FIG. 3 is a fragmentary perspective view of a portion of the guardrail barrier of FIG. 1.

In FIG. 3, there is shown a fragmentary perspective view of the guardrail barrier 16 showing the upper and lower outer curves 30A and 32A. As best understood from this view, each of the outer curves is asymmetrical rather than being a single arc with a single center of curvature. Similarly, the center portion of the barriers may have no curvature or almost no curvature and the curvature, if any, should face in a negative direction from the peaks of the outer curves.

The outer sections 33A and 35A on the outside slope of the peaks 30A, 32A respectively (above and below the peaks 30A and 32A respectively) are close to horizontal in the preferred embodiment and the inner sides 37A of the upper outer curve 30A and 39A of the lower curve 32A slope towards each other in the preferred embodiment shown in FIG. 7. This minimizes the moment of inertia of the guardrail barrier to permit bending or other metal working, reduces crushing to a flat shape because of the steep outer portions 33A and 35A, 35B and the sloping inner portions 37A and 39A reduce the tendency to form a hump in the center portions 34A. The crushing of the peaks could reduce the moment of inertia to a value that is too low and perhaps cause an undesirable fracture and the creation of a hump could also change the moment of inertia in an undesired direction.

The force necessary to crush the outer curves or form a large central hump is referred to herein as the crushing force. The desired range of crushing force is determined by the thickness of the material and the facing angles, theta and beta, made by each pair of outer and inner section of the peak. The outer sections, 35C and 33C, each an angle theta with the horizontal and the inner sections 37C and 39C each make an angle beta with the horizontal. The desired crushing strength for a steel beam is in a range of thickness of between 15 gauge to 10 gauge and a ratio of theta to beta in the range of 1.2 to 6. The preferred ratio is 1.8.

In FIG. 4, there is shown a fragmentary plan view of the guardrail system 10 with the vehicle 12 positioned to hit the terminal assembly 18 rather than the guardrail barrier 16. As shown in this embodiment, it is intended that the terminal buckle, bend, cut or otherwise alter the guardrail barrier to cause the guardrail system to absorb energy, and for that reason, the guardrail barrier has an appropriate moment of inertia of its section and is made of a material which is relatively stiff but capable of buckling, bending or otherwise being deformed. Any mechanisms for absorbing energy may also be used at in conjunction with the guardrail such as slicing the guardrail or extruding it or the like in a manner known in the art.

In FIG. 5, there is shown a side view of an embodiment of a guardrail system 10A having upper and lower outer curves 30A and 32A respectively and a center portion 34A. This embodiment illustrates the effect of relatively large radii of curvature of the outer portions in providing high moment of inertia against buckling and bending upon impact with a relatively low membrane action as controlled by the center portion 34A.

Similarly in FIGS. 6, 7, 8, 10 and 11, configurations for embodiments of guardrail systems 10B, 10C, 10D, 10F and 10G are shown with differing amounts of metal being required in accordance with the length and different balances between membrane action and beam type action. Similarly, FIGS. 9, 12 and 13 show additional beam type resistance created by a central curved portion such as 36E, 36H and 36I respectively in the embodiments of guardrail systems 10E, 10H and 10I respectively.

Several possible variations in characteristics are shown in table 1 for beams such as those shown by 10A–10I in FIGS. 5–13. With these configurations, the distance and direction a car of a predetermined momentum, direction and height of center of mass moves after impact with a barrier can be controlled to some extent. The center portion 34 determines the effective capture area of different elevations of vehicles so that the larger this area, the better its capture characteristics. Similarly, the lower the section modulus: (1) the better the membrane action, the longer the vehicle can move against resistance and the longer the time available for redirecting the vehicle; (2) the greater the reduction in destabilizing forces and thus the less chance of rolling; and (3) the lower the moment of inertia. High moments of inertia: (1) cause faster reduction and increase in forces, thus increasing rollover; (2) increase the chances the tires will push back into the occupant compartment; and (3) increase impact forces. The greater the moment of inertia, the faster energy is absorbed and the vehicle slowed down.

A preferred embodiment of barrier should have the characteristics substantially as shown in column 3CTAB in table 1 and in FIG. 7. "Substantially" in this specification and claims means within 20 percent. In the preferred embodiment, the outer curves 30C, 32C are each asymmetric, are identical to each other, a center of curvature of their peaks that is substantially two and one eighth inches from the base negative extreme point and a radius of curvature at the outermost portions of fifteenth sixteenths inch. The distance at the base of the peaks from one end of the outer curves 33C to the point they inner curve 37C meets the center portion 34C of five and one quarter inches. The apex of the curved portion 30C is substantially one and one half inch from the point the outer section 33C crosses the base line and four inches from the point the inner curve 37C meets the center portion 34 at its base. The center portion is substantially four and one quarter inches long.

The characteristics of suitable barriers should fall within a certain range from a first set of characteristics to a second set of characteristics. Surprisingly, the range of characteristics has a reduced thickness (increased gauge) of material and increased depth and effective depth without an increased weight per unit length of the barrier of such a magnitude as to greatly increase the cost or, increase the moment of inertia or increase the likelihood of crushing the curved portions of the barrier and thus reduce its moment of inertia. The characteristics defining the range between the first set of characteristics and second set are not necessarily to be found in one barrier design. The range is given for the same material and the same thickness and gauge but the material can be varied as described above.

The beneficial results are obtained from a barrier having dimensions falling within certain ranges such as for example a range of edge areas, reflecting the amount of steel or other material per unit length of guardrail barrier, and the effective depths. This range is between an edge area of substantially 1.6 square inches with an effective depth of substantially 15 inches to an edge area of substantially 2.4 square inches with an effective depth of substantially 9 inches. The preferred edge area and effective depth are substantially 1.99 square inches edge area with substantially 12.25 inches effective depth and the effective section modulus is 1.31. The section modulus, Sy, should fall within the rod of 0.94 to 1.7.

A range of effective depths and moments of inertia is from an effective depth of 15 inches with a moment of inertia of 3.57 in.$^4$ to an effective depth of 9 inches with a moment of inertia of 1.38 in.$^4$. The preferred moment of inertia is 2.39 in.$^4$.

A range of peak crush strength is between 3 kips (thousand pounds) per foot to 6.5 kips per foot. The preferred peaks crush strength is 4.97 kips per foot. A suitable range of energy absorption caused by crushing is between 7 kips in. per foot and 15 kips in. per foot. The preferred value is 10.7 kips in. per foot or rail. This is best obtained by asymmetrical end curves with ratios of angles of the sloping inner side of outer curves to angles of outer side of curves (facing angles) with the horizontal of 1.2 to 6. The preferred angles are

TABLE 1

| I.D. No. | W-Beam Standard | W-Beam 1B | W-Beam 3A | W-Beam 3C | W-Beam 5A | W-Beam 5C | W-Beam 3CTAB |
|---|---|---|---|---|---|---|---|
| Area | 1.9904 | 1.9966 | 2.0001 | 2.0003 | 2.0126 | 2.0000 | 1.9930 |
| Thickness | 0.1046 | 0.0897 | 0.0897 | 0.0897 | 0.0897 | 0.0897 | 0.0897 |
| Gauge | 12.0000 | 13.00000 | 13.0000 | 13.0000 | 13.0000 | 13.0000 | 13.0000 |
| Depth | 12.2500 | 15.4375 | 14.9062 | 14.5479 | 13.3680 | 12.8728 | 15.2354 |
| Effective Depth | 7.6250 | 10.8128 | 10.8539 | 11.6764 | 10.6436 | 11.0744 | 12.2500 |
| Width | 3.3546 | 3.3660 | 3.3660 | 3.3660 | 3.3660 | 3.3660 | 3.2730 |
| Xbar | 6.1250 | 7.7188 | 7.4531 | 7.2739 | 6.6840 | 6.4364 | 7.6177 |
| Ybar | 1.6839 | 1.4751 | 1.3867 | 1.3031 | 1.2815 | 1.2966 | 1.4503 |

TABLE 1-continued

| I.D. No. | W-Beam Standard | W-Beam 1B | W-Beam 3A | W-Beam 3C | W-Beam 5A | W-Beam 5C | W-Beam 3CTAB |
|---|---|---|---|---|---|---|---|
| Ix | 29.6494 | 48.7110 | 47.1189 | 48.5116 | 42.4567 | 42.5975 | 52.2648 |
| Iy | 2.3235 | 2.6190 | 2.6341 | 2.6331 | 2.6832 | 2.6593 | 2.3877 |
| Sx | 4.8407 | 6.3107 | 6.3220 | 6.6692 | 6.3520 | 6.6182 | 6.8610 |
| Sy1 | 1.3754 | 1.7755 | 1.8995 | 1.8752 | 2.0938 | 2.0509 | 1.6463 |
| Sy2 | 1.3952 | 1.3851 | 1.3309 | 1.3421 | 1.2872 | 1.2850 | 1.3100 |
| Length | 19.0287 | 22.2200 | 22.3808 | 22.2982 | 22.4224 | 22.2423 | 22.2178 |
| Weight/volume | 4900.0000 | 490.0000 | 490.0000 | 490.0000 | 490.0000 | 490.0000 | 490.0000 |
| Weight/Length | 6.7729 | 6.7941 | 6.8059 | 6.8064 | 6.8483 | 6.8056 | 6.7817 |

43.5 degrees for inner side and 78.66 degrees for outer curve with a ratio of 1.8.

To prevent tearing out bolts at between sections, at least 10 bolts in several rows should be used to hold the sections together. Each bolt should have a bearing area less than 0.079 square inches. The total bearing area should be at least 0.56 square inches.

The beam energy absorbing characteristics and membrane characteristics are selected principally by controlling the section modulus, the moment of inertia and the edge area. The vehicle redirecting characteristics and to some extent the energy storing and yield characteristics are determined by the location of the centroid and radii of gyration. The capture area is determined by the geometry while maintaining the desired moment of inertia and edge area. For economic reasons, the thickness and linear length of the material used to form the barrier and guardrail impact energy moment must be considered in the design.

The characteristics defining the range between the first set of characteristics and second set are not necessarily to be found in only one barrier design.

The first set of characteristics is: (1) an edge area of substantially 1.6 square inches; (2) a thickness of substantially 0.0721 inches; (3) a depth of substantially 14.5 inches; (4) an effective depth of substantially 9 inches; (5) a moment of inertia, Iy, of substantially 1.38 in.$^4$; and (6) an Sy of substantially 0.92 in.$^3$.

The second set of characteristics is: (1) an area of substantially 2.4 square inches; (2) a thickness of substantially 0.1082 inches; (3) a depth of substantially 19.0 inches; (4) an effective depth of substantially 15 inches; (5) a moment of inertia, Iy, of substantially 3.57 in.$^4$; and (6) an Sy of substantially 1.7in.$^3$.

A range of possible first values for a first barrier at one end of the range and possible second values for a second barrier at the other end of the range is: (1) for the first barrier—an area of substantially 1.6 square inches, a thickness of substantially 0.0721 inches, an effective depth of substantially 15 inches, a moment of inertia, Iy, of substantially 1.38 in.$^4$, an Sy of substantially 0.92 in.$^3$; to (2) for the second barrier—an area of substantially 2.4 square inches, a thickness of substantially 0.1082 inches, an effective depth of substantially 9 inches, a moment of inertia, Iy, of substantially 3.57 in.$^4$, an Sy of substantially 1.7 in$^3$.

From the above description it can be understood that the guardrail barrier of this invention has several advantages such as: (1) it permits absorbing of energy, such as for example by efficient buckling, bending, cutting or other metal working when the vehicle hits a terminal; (2) it provides a long capture area for vehicles that are at different elevations from the ground; (3) it reduces the tendency for vehicles having a high center of mass to roll, vault over the barrier while at the same time preventing small vehicles from diving under the barrier off of the road; (5) it permits adaptation of the guardrail to vehicles having different heights of centers of masses; and (6) it permits economizing with the amount of metal to achieve the desired result of redirection of vehicles and slowing them down while protecting them from leaving the road and without causing premature failure of the guardrail material.

Although a preferred embodiment of the invention has been described with some particularity, many modifications and variations in the invention are possible in light of the above teachings. Therefore, it is to be understood that, within the scope of the appended claims, the invention may be practiced other than as specifically described.

What is claimed is:

1. A guardrail barrier that balances section modulus, moment of inertia and membrane effect comprising:

outer curves;

a central portion between said outer curves;

the central portion and outer curves being positioned to provide an effective depth of between substantially 9 to 15 inches;

said section modulus being below 1.7 in.$^3$.

2. A guardrail barrier in accordance with claim 1 in which the moment of inertia, length of the edge and area of the edge of the guardrail barrier are selected to reduce the tendency of the vehicle to roll, vault over the barrier or crush the occupant compartment.

3. A guardrail barrier in accordance with claim 2 having:

characteristics falling within a certain range from a first set of characteristics to a second set of characteristics;

said first set of characteristics including an edge area of substantially 1.6 square inches, an effective depth of substantially 9 inches, a section modulus of substantially 0.92 in.$^3$ and a moment of inertia of substantially 3.5 in.$^4$; and said second set of characteristics including an area of 2.4 square inches, an effective depth of 15 inches, a section modulus of 1.7 in.$^3$ and a moment of inertia of 1.5 in.$^4$.

4. A guardrail barrier in accordance with claim 1 in which the area of the edge of the guardrail barrier is substantially between 1.6 square inches and 2.4 square inches.

5. A guardrail barrier in accordance with claim 4 in which the crush strength of the barrier is high enough wherein the force necessary to flatten the outer curves is more than 3 kips per foot.

6. A guardrail barrier in accordance with claim 4 in which the crush strength of the barrier is sufficiently low so that the outer curves are flattened by a force less than 6.5 kips per foot.

7. A guardrail barrier in accordance with claim 4 in which the section modulus is at least 0.92 in.$^3$.

8. A guardrail barrier in accordance with claim 1 in which the moment of inertia is in a range of between 3.57 in.$^4$ to 1.38 in.$^4$.

9. A guardrail barrier in accordance with claim 1 in which said guardrail barrier comprises:

at least first and second sections of guardrail;

said first and second sections each having a plurality of openings in their ends with the opening in the first section being aligned with the sections in the second section to form a splice;

bolts extending through at least some of said openings, wherein said sections are held together;

there being at least two vertical rows of bolts;

one of said rows of bolts being closer to the edge of a barrier than the others;

each of curved portions having a peak;

said one of said rows of bolts being located in an area between the peaks of said outer curved portions.

10. A guardrail barrier in accordance with claim 1 in which:

each of said outer curves has an outer surface extending in a generally horizontal direction, a peak and an inner surface extending downwardly toward the central portion;

said outer surfaces each having a straight length of at least two inches;

said inner surfaces each having a straight section;

the ratio of the angle said outer surface makes with the vertical to the angle said inner surface makes with the vertical being in a range of between 1.2 and 6.

11. A guardrail barrier in accordance with claim 1 in which said outer curves are asymmetrical.

12. A guardrail barrier in accordance with claim 1 in which the outer curves each have sloping inner sides between peaks of the curves and the central portion and outer curves, the ratio of the angles with respect to the vertical of the inner sides to the outer curves being in a range of 1.2 to 6.

13. A guardrail barrier in accordance with claim 1 in which the barrier includes at least two continuous sections having aligned bolt holes adapted to receive bolts and hold the sections together, there being more than ten such bolt holes and having a bearing area less than 0.079 square inches and a total bearing area of at least 5.6 square inches.

14. A guardrail barrier that balances section modulus, moment of inertia and membrane effect comprising:

outer curves;

a central portion between said outer curves;

the central portion and outer curves being positioned to provide an effective depth of between substantially 9 to 15 inches;

said guardrail barrier having an area of substantially 1.99 square inches, a thickness of substantially 0.0897 inches, a gauge of substantially 13.00, an effective depth of substantially 12.25 inches and a moment of inertia of substantially 2.39 in.$^4$, an Sy of substantially 1.31 in.$^3$.

15. A guardrail barrier that balances section modulus, moment of inertia and membrane effect comprising:

outer curves;

a central portion between said outer curves;

the central portion and outer curves being positioned to provide an effective depth of between substantially 9 to 15 inches;

a plurality of sections;

at least the end of one section being spliced to the end of a second section;

said splice consisting of apertures in the end of the first section lined with apertures in the end of the second section and bolts fastening the sections together through said apertures;

there being at least 10 bolts;

each of said bolts providing surface contact with each of said sections at the edges of the sections in a direction parallel to the longitudinal axis of the sections of less than 0.079 square inches.

16. A guardrail barrier in accordance with claim 15 in which:

said splice includes 12 apertures in each of said one end and second end and six bolts in each of said first end and said second end; and said bolts being ⅝ inch diameter bolts.

* * * * *